United States Patent [19]

Hashizume

[11] Patent Number: 4,485,367

[45] Date of Patent: Nov. 27, 1984

[54] COOLING APPARATUS FOR A GAS INSULATED TRANSFORMER

[75] Inventor: Kenichi Hashizume, Tokyo, Japan

[73] Assignee: Tokyo Shibaura Denki Kabushiki Kaisha, Kawasaki, Japan

[21] Appl. No.: 442,643

[22] Filed: Nov. 18, 1982

[30] Foreign Application Priority Data

Dec. 25, 1981 [JP] Japan ..... 56-209380

[51] Int. Cl.[3] ..... H01F 27/10

[52] U.S. Cl. ..... 336/57; 174/15 R

[58] Field of Search ..... 174/15 R; 336/57, 58, 336/60; 165/117, 104.33

[56] References Cited

U.S. PATENT DOCUMENTS

| | | | |
|---|---|---|---|
| 2,689,465 | 9/1954 | McNeely | 165/117 |
| 2,853,540 | 9/1958 | Camilli et al. | 174/17 GS |
| 2,924,635 | 2/1960 | Narbut | 174/15 R |
| 3,174,540 | 3/1965 | Dutton | 165/104.33 X |
| 3,243,495 | 3/1966 | Mazza | 174/15 |
| 3,316,727 | 5/1967 | Bourne | 165/117 |
| 3,452,147 | 6/1969 | Narbut et al. | 336/57 |
| 4,011,535 | 3/1977 | Kosky et al. | 174/15 R X |
| 4,039,990 | 8/1977 | Philip | 336/60 |
| 4,048,603 | 9/1977 | Staub et al. | 336/60 X |
| 4,117,525 | 9/1978 | Moore | 336/57 |
| 4,129,845 | 12/1978 | Benke | 174/15 R X |
| 4,149,134 | 4/1979 | Kothmann et al. | 336/57 |
| 4,205,289 | 5/1980 | Stubblefield | 336/58 |
| 4,276,530 | 6/1981 | Benke et al. | 336/58 |

FOREIGN PATENT DOCUMENTS 2844884 4/1979 Fed. Rep. of Germany .

OTHER PUBLICATIONS

OHM; 1981 Sep. Issue; pp. 18 to 24 K. Tokoro (transliterated) et al.; "Development of a Vaporization Cooled Gas Insulated Transformer and a Total Gas Insulation of a Substation".

Industrial Power Systems, Sep., 1978 pp. 3 to 8 Moris, R. T.; "New Concept in Transformer Design".

*Primary Examiner*—John Gonzales

*Assistant Examiner*—Morris H. Nimmo

*Attorney, Agent, or Firm*—Oblon, Fisher, Spivak, McClelland & Maier

[57] ABSTRACT

A cooling apparatus for a gas insulated transformer has a tank which houses coils and an iron core and in which an electrically insulating gas is sealed. A reservoir housing the coils and having an outlet at its upper end is disposed inside the tank. Spray equipment with a plurality of spray nozzles is also disposed inside the tank. A first cooling unit for cooling the cooling medium flowing down in the tank and collected in the first cooling unit is disposed at the bottom of the tank. The cooling medium cooled by the first cooling unit is supplied to the reservoir and cools the coils while flowing through gaps therebetween. Some cooling medium is converted into vapor by the heat generated by the coils. The cooling medium cooled by the first cooling unit is further cooled by a second cooling unit and is sprayed into the interior of the tank from the spary nozzles. The vapor in the tank directly contacts the mist of the cooling medium sprayed from the spray nozzles and is condensed.

10 Claims, 3 Drawing Figures

COOLING APPARATUS FOR A GAS INSULATED TRANSFORMER

BACKGROUND OF THE INVENTION

The present invention relates to a cooling apparatus for a gas insulated transformer wherein coils and an iron-core are housed in a tank in which an electrically insulating gas is sealed.

In a conventional oil filled transformer, coils and an iron core are housed in a tank which is filled with an electrically insulating oil. The insulating oil serves to insulate and cool the coils, the iron core and so on. However, use of such an oil filled transformer is not desirable from the viewpoint of safety. A nonflammable transformer is thus desired, an example of which is a gas insulated transformer. In a gas insulated transformer of this type, an electrically insulating gas such as $SF_6$ gas is sealed in a tank housing coils and an iron core therein to insulate them. The coils and iron core are also cooled upon contact with a volatile cooling medium in the liquid phase.

The cooling medium evaporates by extracting heat from the coils. The vapor of the cooling medium is coexistent with a noncondensable insulating gas in the tank. If the noncondensable insulating gas is mixed in the vapor of the cooling medium, even in a small amount, condensation heat transfer coefficient of the vapor of the cooling medium is significantly lowered. In a gas insulated transformer of the vaporization cooled type which is cooled with the cooling medium, the coils are cooled by being sprayed with the cooling medium in the liquid phase, and the vapor of the cooling medium generated by this cooling process is condensed by a cooling unit. However, as mentioned earlier, mixing of the insulating gas renders condensation of the vapor of the cooling medium difficult. For this reason, the temperature of the cooling medium for cooling the coils and the like is raised, resulting in degradation of the cooling efficiency and an increase in the internal pressure of the tank. In order to prevent these problems, a cooling unit of large capacity must be mounted, and the overall apparatus becomes bulky, costly and heavy.

A gas insulated transformer, of separate cooling type has also been proposed wherein a duct for flowing a cooling medium therethrough is incorporated within the coils so as to cool the coils, instead of spraying them with the cooling medium. However, in order to obtain satisfactory cooling effects, a cooling duct of small wall thickness must be incorporated throughout the height (about 1 to 2 m) of the coils, which makes the manufacture of the apparatus difficult.

SUMMARY OF THE INVENTION

It is an object of the present invention to provide a cooling apparatus for a gas insulated transformer, which is capable of efficiently condensing the vapor of a cooling medium generated upon cooling the coils.

It is another object of the present invention to provide a cooling apparatus for a gas insulated transformer, which is capable of cooling coils and an iron core with high efficiency.

It is still another object of the present invention to provide a cooling apparatus for a gas insulated transformer, which is simple in construction, easy to manufacture, light in weight and compact in size.

In order to achieve these and other objects, there is provided according to the present invention a cooling apparatus for a gas insulated transformer comprising a tank in which an insulating gas is sealed; an iron core disposed inside said tank; coils wound around said iron core inside said tank; first cooling means for supplying a cooling medium to said coils for cooling said coils, so that the heat of the coil converts part of the cooling medium into a vapor; second cooling means disposed inside said tank, for spraying the cooling medium into an interior of said tank so as to condense the vapor of the cooling medium converted by the heat of the coils, the temperature of the cooling medium sprayed, by said second cooling means being not higher than the temperature of the cooling medium supplied by said first cooling means; a feed device for feeding the cooling medium to said first and second cooling means; and a cooling device for cooling the cooling medium fed to said first and second cooling means.

DETAILED DESCRIPTION OF THE PREFERRED EMBODIMENTS

Figure 1:
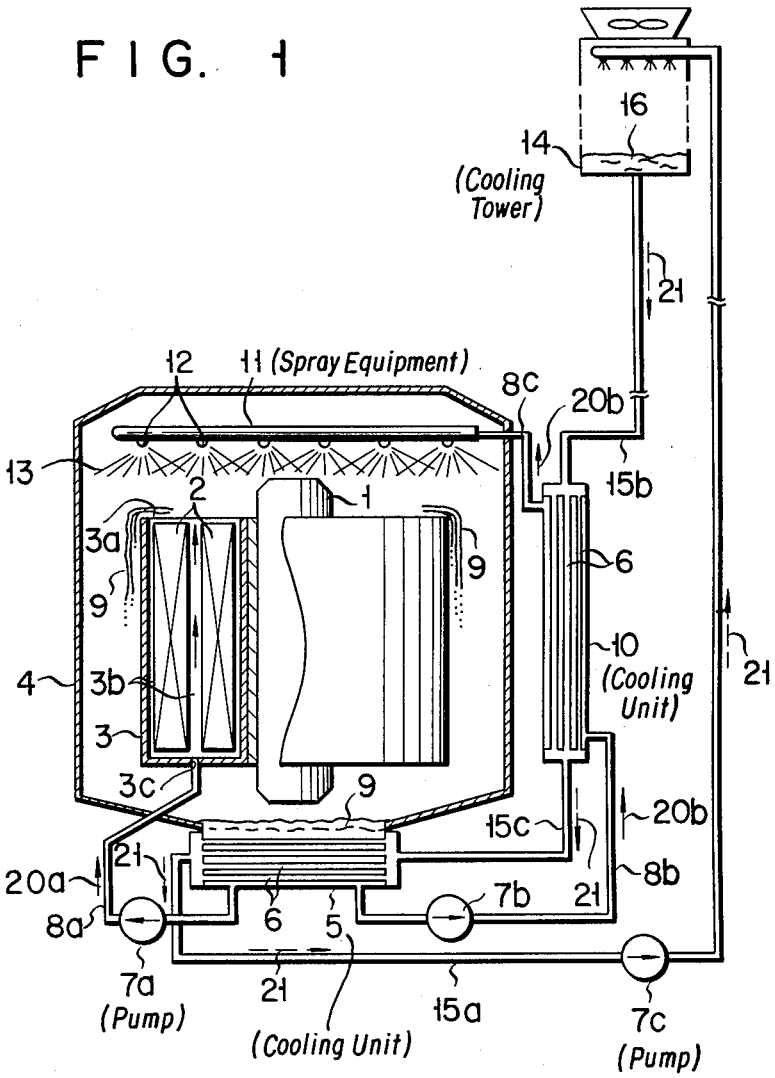
FIG. 1 is a view showing a cooling apparatus for a gas insulated transformer according to the first embodiment of the present invention.

FIG. 1 shows a cooling apparatus for a gas insulated transformer according to the first embodiment of the present invention. In this gas insulated transformer, an iron core 1 and coils 2 are housed in a tank 4 which is filled with an electrically insulating gas such as $SF_6$ gas. The coils 2 wound on the iron core 1 are housed within a reservoir 3 having an outlet 3*a* at its upper end. A cooling unit 5 is arranged at the bottom of the tank 4. A plurality of cooling pipes 6 are assembled in the cooling unit 5. A cooling medium 9 in the liquid phase such as Refrigerant R113 (otherwise known as $C_2F_3Cl_3$, or trifluourotrichloroethane) is held in the cooling unit 5. The lower end of the cooling unit 5 communicates with an inlet 3*c* at the bottom of the reservoir 3 through a pipe 8*a*. A pump 7*a* is mounted in the pipe 8*a*. After the cooling medium 9 in the tank 4 is collected in the cooling unit 5, it is pumped into the reservoir 3 by the pump 7*a*. The coils 2 are housed in the reservoir 3 so as to define small gaps 3*b* between itself and the walls of the reservoir 3. The cooling medium 9 which is pumped into the reservoir 3, as indicated by an arrow 20*a*, flows through the gaps 3*b* and overflows through the outlet 3*a* at the upper end of the reservoir 3. The cooling medium 9 is then collected into the cooling unit 5 at the bottom of the tank 4.

Spray equipment 11 having a plurality of spray nozzles 12 is arranged above the coils 2 and the iron core 1 inside the tank 4. A cooling unit 10 communicates through a pipe 8*c* with the spray equipment 11. The cooling unit 10 has a plurality of cooling pipes 6 assembled therein. The lower part of the cooling unit 10 communicates with the bottom of the cooling unit 5 through a pipe 8*b*. A pump 7*b* is mounted in the pipe 8*b*. The cooling medium 9 inside the cooling unit 5 is pumped into the cooling unit 10 by the pump 7*b* as indicated by an arrow 20*b*, is passed through the cooling unit 10, and is then supplied to the spray equipment 11. The cooling medium 9 is then sprayed from spray nozzles 12 into the interior of the tank 4.

A cooling tower 14 for cooling the cooling water 16 stored therein is disposed outside the tank 4. The cooling tower 14 communicates with the cooling pipes 6 inside the cooling unit 10 through a pipe 15*b*. The cooling pipes 6 inside the cooling unit 10 communicate with those in the cooling unit 5 through a pipe 15*c*. The cooling pipes 6 inside the cooling unit 5 communicate with the cooling tower 14 through a pipe 15*a*. A pump 7*c* is mounted in the pipe 15*a* to return the cooling water 16 to the cooling tower 14 after it is passed through the cooling pipes 6 inside the cooling units 5 and 10, as shown by dotted arrows 21. While the cooling water 16 is passed through the cooling pipes 6 inside the cooling unit 10, it cools the cooling medium 9 to be supplied to the spray equipment 11 through the pipes 8*b* and 8*c*. When the cooling water 16 is passed through the cooling pipes 6 of the cooling unit 5, it cools the cooling medium 9 stored in the cooling unit 5.

The mode of operation of the gas insulated transformer of the configuration as described above will now be described. The cooling medium 9 cooled by the cooling unit 5 is supplied to the reservoir 3 through the inlet 3*c* at its bottom by the pump 7*a*, and it then overflows from the outlet 3*a* after being passed through the gaps 3*b*. While the cooling medium 9 flows through the gaps 3*b* to overflow from the outlet 3*a*, it is brought into contact with the coils 2 to extract heat generated therein upon current flow, thereby cooling them. The cooling medium 9 which has cooled the coils 2 in this manner is partially evaporated; the vapor becomes coexistent in the interior of the tank 4 and the remaining portion of the cooling medium 9 overflows from the outlet 3*a* of the reservoir 3 and is collected in the cooling unit 5 at the bottom of the tank 4.

The cooling medium 9 which is collected in the cooling unit 5 is also supplied to the cooling unit 10 by the pump 7*b*. The cooling medium 9 supplied to the cooling unit 10 is cooled thereby to a lower temperature than that cooled by the cooling unit 5, since the cooling unit 10 is disposed upstream of the cooling unit 5 along the direction of flow of the cooling water 16. The cooling medium cooled by the cooling unit 10 is supplied to the spray equipment 11 which sprays it into the interior of the tank 4 from the spray nozzles 12. The cooling medium 9 evaporates upon contact with the coils, and the vapor of the cooling medium in the interior of the tank 4 is brought into direct contact with mist 13 of the cooling medium sprayed from the spray nozzles 12. Since the vapor directly contacts the mist 13 and the surface area of the mist 13 is extremely large, the vapor of the cooling medium condenses efficiently and is collected in the cooling unit 5 at the bottom of the tank 4 in liquid phase. Since the vapor of the cooling medium 9 is efficiently condensed, a cooling unit of large capacity need not be incorporated, so that the overall apparatus may be rendered simple in construction, compact in size and light in weight. Furthermore, since the cooling medium 9 which cools the coils 2 is only present in the gaps 3*b* inside the reservoir 3, the amount of the cooling medium 9 required is small, which also results in a lightweight and low-cost apparatus. Spraying also serves to cool the iron core.

Figure 2:
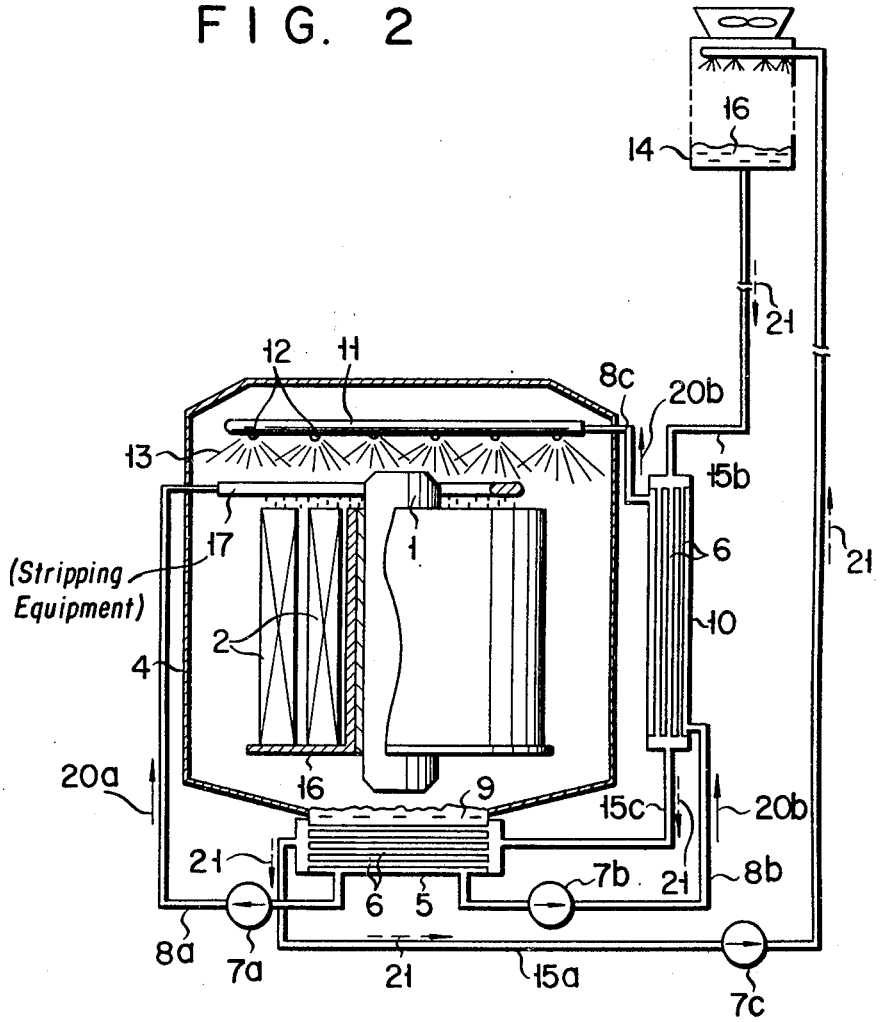
FIG. 2 is a view showing a cooling apparatus for a gas insulated transformer according to the second embodiment of the present invention.

FIG. 2 shows a cooling apparatus for a gas insulated transformer according to the second embodiment of the present invention. Unlike the first embodiment where the coils 2 is cooled by passing the cooling medium 9 through the gaps 3*b* in the reservoir 3, the coils 2 are cooled in the second embodiment by dripping the cooling medium from a position above the coils 2. The same reference numerals as in FIG. 1 denote the same parts in FIG. 2, and a detailed description thereof will be omitted. The coils 2 are set on a suitable frame 16. Dripping equipment 17 for dripping the cooling medium 9 is arranged below the spray equipment 11 and above the coils 2 at a small distance from the upper ends thereof. The bottom of the cooling unit 5 communicates with the dripping equipment 17 through the pipe 8*a*. The cooling medium 9 stored in the cooling unit 5 is supplied to the dripping equipment 17 by the pump 7*a* mounted in the pipe 8*a*, and drips onto the coils 2 from the dripping equipment 17. The cooling medium 9 dripped onto the coils 2 contacts the coils 2 and the iron core 1 to cool them. The cooling medium is partially evaporated by heat generated by the coils 2, and the remaining portion thereof is collected in the cooling unit 5 at the bottom of the tank 4. As in the first embodiment, the vapor of the cooling medium is brought into direct contact with mist 13 of the cooling medium 9 sprayed from spray nozzles 12, condenses into liquid, drips into the cooling unit 5, and is collected therein.

Figure 3:
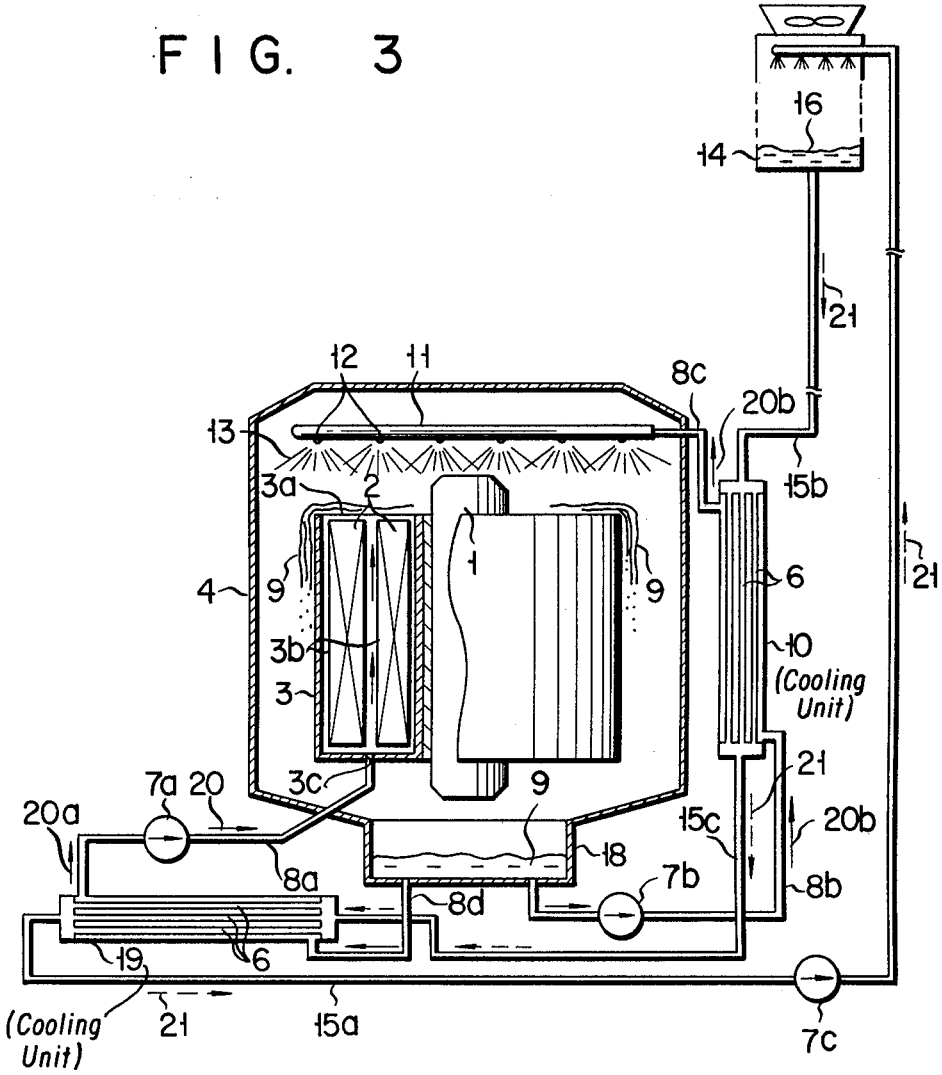
FIG. 3 is a view showing a cooling apparatus for a gas insulated transformer according to the third embodiment of the present invention.

FIG. 3 shows a cooling apparatus for a gas insulated transformer according to the third embodiment of the present invention. The third embodiment is different from the first embodiment (FIG. 1) in that a portion of a cooling medium for cooling coils 2 and another portion of the cooling medium for condensing the vapor of the cooling medium in a tank 4 are cooled by independent cooling units 19 and 10, respectively. The same reference numerals as in FIG. 1 denote the same parts in FIG. 3, and a detailed description thereof will be omitted. A collector 18 for collecting the cooling medium 9 is disposed at the bottom of the tank 4 in place of the cooling unit 5 (FIG. 1). The bottom of the collector 18 communicates with the end of the cooling unit 10 through the pipe 8*b* and communicates with one end of the cooling unit 19 through a pipe 8*d*. A plurality of cooling pipes 6 are assembled in the cooling unit 19. The other end of the cooling unit 19 communicates with the inlet 3*c* of the reservoir 3 through the pipe 8*a*. The cooling medium 9 in the collector 18 is supplied to the cooling unit 10 through the pipe 8*b* by the pump 7*b* mounted therein. The cooling medium 9 is also supplied to the reservoir 3 through the inlet 3*c* by the pump 7*a* mounted in the pipe 8*a* after passing through the cooling unit 19. The cooling water inlet of the cooling unit 19 communicates with the cooling water outlet of the cooling unit 10 through the pipe 15*c*. The cooling water outlet of the cooling unit 19 communicates with the cooling tower 14 through the pipe 15*a*. Therefore, cooling water 16 in the cooling tower 14 passes through the cooling pipes 6 of the cooling units 10 and 19, and is returned to the cooling tower 14 by the pump 7*c*. The cooling medium flowing through the cooling units 10 and 19 is cooled by the cooling water 16 circulated in this manner. If the capacity of the cooling unit 10 is the same as that of the cooling unit 19, the cooling medium supplied from the cooling unit 10 is cooled to a lower temperature than that supplied from the cooling unit 19 since the cooling unit 10 is disposed upstream of the cooling unit 19 along the direction of flow of the cooling water 16.

The cooling medium 9 which flows through the gaps 3*b* and contacts the coils 2 to cool them is cooled by the cooling unit 19. Meanwhile, the cooling medium 9 which is sprayed from the spray nozzles 12 and condenses the vapor of the cooling medium in the space inside the tank 4 is cooled by the cooling unit 10. Therefore, the temperatures of the cooling media may be set arbitrarily. The iron core is cooled by spraying.

According to the present invention, the vapor of the cooling medium, which has cooled the coils 2 and has evaporated, contacts the mist 13 of the cooling medium sprayed from the spray nozzles 12, condenses into liquid, and drips into the tank 4. Since the vapor of the cooling medium is efficiently condensed by the mist, it may be recovered with a high yield in liquid phase. Thus, the internal pressure of the tank 4 may not be inadvertently raised, and the temperature of the cooling medium may not be raised. Furthermore, since a cooling unit of large capacity need not be incorporated, the overall apparatus can be rendered compact in size, light in weight, and low in manufacturing cost. The temperature of the cooling medium which is sprayed into the tank 4 and condenses the vapor of the cooling medium is preferably set to be lower than that of the cooling medium for cooling the coils 2 for the purpose of improving the condensation efficiency of the vapor. However, even if the temperatures of both cooling media are set to be the same, the vapor of the cooling medium in the tank 4 can be condensed by the cooling medium sprayed from the spray nozzles. For this reason, the cooling unit 10 (FIG. 1), for example, need not always be incorporated in addition to the cooling unit 5. In this case, the cooling medium cooled by the cooling unit 5 can be directly supplied to the spray nozzles 12. If a cooling unit of larger capacity than the cooling unit 5 is used for the cooling unit 10, the temperature of the cooling medium sprayed from the spray nozzles 12 may be set to be lower than that of the cooling medium supplied to the reservoir 3, even if the direction of flow of the cooling water 16 is reversed from that indicated by dotted arrows 21 in FIG. 1. In order to increase the cooling capacity of the cooling unit 10, the number of cooling pipes 6 to be assembled in the cooling unit 10 may be increased.

What is claimed is:

1. A cooling apparatus for a gas insulated transformer, said cooling apparatus comprising:

(a) a tank in which an insulating gas is sealed;

(b) a transformer located in said tank, said transformer having an iron core and coils wound around said iron core and being insulated electrically by said insulating gas inside said tank;

(c) fluid coolant for cooling said transformer;

(d) contacting means for contacting said transformer with said fluid coolant while said fluid coolant is in its liquid phase, thereby cooling said transformer when the heat of said coils converts part of said fluid coolant in its liquid phase into vapor;

(e) condensing means for generating a mist of said fluid coolant in its liquid phase in the interior of said tank and for causing said mist to directly contact said vapor to condense said vapor back into the liquid phase of said fluid coolant;

(f) a feed device for collecting said fluid coolant after it has been condensed back into its liquid phase and for feeding said fluid coolant in its liquid phase to said contacting means and to said condensing means; and (g) a cooling device which cools said fluid coolant in its liquid phase while it is being fed to said contacting means and to said condensing means so that the temperature of said fluid coolant in its liquid phase fed to said condensing means is lower than the temperature of said fluid coolant in its liquid phase fed to said contacting means.

2. An apparatus according to claim 1, wherein said contacting means comprises a reservoir for housing said transformer so as to define a gap between said reservoir and said coils, said reservoir having an outlet at an upper end thereof and an inlet at a lower end thereof, the fluid coolant in its liquid phase flowing into said reservoir through the inlet and flowing out through the outlet, so as to be brought into contact with said coils to cool said coils.

3. An apparatus according to claim 1, wherein the fluid coolant is a flurorocarbon which has the chemical composition of $C_2F_3Cl_3$.

4. An apparatus according to claim 1 wherein said cooling device comprises a first cooling unit which is arranged at the bottom of said tank and which cools the fluid coolant in its liquid phase.

5. An apparatus according to claim 4 wherein:

(a) said cooling device comprises a second cooling unit which further cools the fluid coolant in its liquid phase cooled by said first cooling unit;

(b) said feed device comprises first feeding means for feeding the fluid coolant in its liquid phase cooled by said first cooling unit to said contacting means; and (c) said feed device further comprises second feeding means for feeding the fluid coolant in its liquid phase cooled by said first cooling unit to said second cooling unit and for feeding the fluid coolant in its liquid phase cooled by said second cooling unit to said condensing means.

6. An apparatus according to claim 4, wherein said contacting means comprises a dripping device for dripping the fluid coolant in its liquid phase arranged above said transformer and in the vicinity thereof, the fluid coolant in its liquid phase dripped from said dripping device being brought into contact with said coils to cool said coils.

7. An apparatus according to claim 1 wherein:

(a) said feeding device comprises a collector which is disposed at the bottom of said tank and which collects the fluid coolant in its liquid phase flowing down in said tank, first feeding means for feeding the fluid coolant in its liquid phase in said collector to said contacting means, and second feeding means for feeding the fluid coolant in its liquid phase in said collector to said condensing means and (b) said cooling device comprises a first cooling unit mounted in said first feeding means for cooling the fluid coolant in its liquid phase fed to said contacting means, and a second cooling unit mounted in said second feeding means for cooling the fluid coolant in its liquid phase fed to said condensing means so that the temperature of the fluid coolant in its liquid phase fed to said condensing means is lower than temperature of the fluid coolant in its liquid phase fed to said contacting means.

8. An apparatus according to claim 1, wherein said condensing means comprises a plurality of spray nozzles which spray the fluid coolant in its liquid phase into the interior of said tank to generate said mist.

9. An apparatus according to claim 5, wherein:

(a) each of said first and second cooling units units has a plurality of cooling pipes assembled therein and (b) said cooling device comprises a cooling tower for cooling water and circulating means for circulating water from said cooling tower into said cooling pipes in said first and second cooling units and from said cooling pipes to said cooling tower.

10. An apparatus according to claim 7, wherein:

(a) each of said first and second cooling units has a plurality of cooling pipes assembled therein and (b) said cooling device comprises a cooling tower for cooling water and circulating means for circulating water from said cooling tower into said cooling pipes in said first and second cooling units and from said cooling pipes to said cooling tower.

* * * * *